US010874263B2

(12) United States Patent
Overley et al.

(10) Patent No.: US 10,874,263 B2
(45) Date of Patent: Dec. 29, 2020

(54) PACKAGE CONTAINING ROLLED PRODUCTS AND PROCESS FOR MAKING SAME

(71) Applicant: The Procter & Gamble Company, Cincinnati, OH (US)

(72) Inventors: Matthew Bernard Overley, Deerfield Township, OH (US); Wesley Bernard Brokopp, Jr., Liberty Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 14/731,788

(22) Filed: Jun. 5, 2015

(65) Prior Publication Data

US 2016/0353943 A1 Dec. 8, 2016

(51) Int. Cl.

| | |
|---|---|
| ***A47K 10/22*** | (2006.01) |
| ***B65D 75/30*** | (2006.01) |
| ***B65D 71/06*** | (2006.01) |
| ***B65D 85/02*** | (2006.01) |
| ***B65D 85/62*** | (2006.01) |
| ***B65D 65/02*** | (2006.01) |

(52) U.S. Cl.

CPC ..... *A47K 10/22* (2013.01); *B65D 65/02* (2013.01); *B65D 71/06* (2013.01); *B65D 71/063* (2013.01); *B65D 75/30* (2013.01); *B65D 85/02* (2013.01); *B65D 85/62* (2013.01)

(58) Field of Classification Search

CPC .... B65D 85/672; B65D 85/676; B65D 85/66; B65D 85/62; B65D 85/16; B65D 71/063; B65D 71/06; B65D 75/30; B65D 85/02; A47K 10/185; A47K 10/18; A47K 10/22

USPC ..... 206/389, 391, 394, 397, 410, 494, 497, 206/812, 407, 484, 484.2, 524.1, 524.2, 206/524.6, 524.9; 53/453

See application file for complete search history.

(56) References Cited

U.S. PATENT DOCUMENTS 2,177,894 A * 10/1939 Lakso ..... B65D 75/26 383/106
4,595,093 A * 6/1986 Eckstein ..... B65D 71/066 206/391
4,765,474 A * 8/1988 James ..... B65D 75/12 206/391
5,054,234 A * 10/1991 Cassells ..... B65D 81/263 206/423

(Continued)

FOREIGN PATENT DOCUMENTS

DE 202009009396 11/2010

OTHER PUBLICATIONS

PCT International Search Report dated Aug. 2, 2016—5 pages. Written Opinion.

*Primary Examiner* — Rafael A Ortiz
(74) *Attorney, Agent, or Firm* — Richard L. Alexander; Andrew J. Mueller

(57) ABSTRACT

A package containing rolled products. The package has an upper side, a lower side opposite and generally parallel to the upper side and four side walls. The sidewalls connect the upper side to the lower side. The package has at least first and second polymer films, the first polymer film forming the upper side and at least a portion of the four side walls, the second polymer film forming at least a portion of the lower side.

10 Claims, 5 Drawing Sheets

(56) References Cited

U.S. PATENT DOCUMENTS

| | | | | |
|---|---|---|---|---|
| 6,643,995 | B1 * | 11/2003 | Koyama | B65B 9/04<br>229/125.35 |
| 8,256,616 | B2 * | 9/2012 | Eilert | B65D 75/5827<br>206/391 |
| 2008/0078685 | A1 * | 4/2008 | Patterson | B65D 5/4204<br>206/391 |
| 2008/0142380 | A1 * | 6/2008 | Unruh | B65D 71/063<br>206/170 |
| 2012/0205272 | A1 * | 8/2012 | Heilman | B65D 75/38<br>206/386 |

* cited by examiner

PACKAGE CONTAINING ROLLED PRODUCTS AND PROCESS FOR MAKING SAME

FIELD OF THE INVENTION

The present invention is related to packages and processes for making packages for products, including rolled products such as rolled toilet paper and paper towels.

BACKGROUND OF THE INVENTION

Products made from a fibrous web are used for a variety of purposes. For example, rolled products such as paper towels and toilet tissues are in constant use in modern industrialized societies. Such rolled products, as well as related products including facial tissues, napkins, and the like, are typically packaged for retail sale. Packaging can include individual polymer wrappers and/or packages of multiple products bundled into a single larger package.

Current approaches to forming packages of rolled products include so-called "flow wrap" technologies. Flow wrappers have an infeed mechanism, such as a conveyor or pushing device, a film feed assembly, a forming area, a cutting head, and a discharge area. Product to be wrapped is placed on the infeed conveyor, which moves generally horizontally to deliver product to a forming area. A single film is drawn from a film feed assembly into the forming area, where the film is formed into a tube around the product as the product is pushed into the tube which is then sealed to create a sealed film tube around the product. The seal can be a lap seal or a fin seal or other known seal as is known in the art of flow wrappers. The film tube and the product then are delivered to a cutting head. The cutting head creates end seals, such as gusset seals, while it cuts apart adjoining wrapped products into individual packages, and delivers the packages to a discharge area for further processing, if necessary.

While flow wrappers are very common and very useful for packaging rolled products, the resulting package has several drawbacks. First, for packages of rolled products in which the cores of the rolled products are oriented vertically with respect to a horizontally process flow, the packages end up with the lap seal being on a side of the package that can be a large consumer-facing side when on a retail store display. Second, the maximum bundle size is limited by the film width, because a single film forms a tube in the process. Third, the gusset seals often fail after processing due to the quantity of material being folded in layers and sealed, creating a quality defect. Fourth, because a single film is used, the film must have material properties exceeding properties necessary for certain parts of the packaging that may be required during processing, shipping, and retail display. This often means that a uniformly relatively thick (i.e., relatively high caliper), strong film must be utilized for the entire package of rolled products.

Accordingly, there is an unmet need for a package that minimizes any lap seals on large faces of a package that can be consumer-facing in a retail store display.

Further, there is an unmet need for a package for which the size is not limited by available film widths or machinery limitations.

Additionally, there is an unmet need for a package having a wrap design that results in better, stronger gusset seals.

Additionally, there is an unmet need for a process for making a package that minimizes any lap seals on large faces of a package that can be consumer-facing in a retail store display.

Additionally, there is an unmet need for a process for making a package that is not limited by available film widths or machinery limitations.

Additionally, there is an unmet need for a process for making a package that is not limited to making packages of a polymer film having uniform film properties.

SUMMARY OF THE INVENTION

A package containing rolled products is disclosed. The package has an upper side, a lower side opposite and generally parallel to the upper side and four side walls. The sidewalls connect the upper side to the lower side. The package has at least first and second polymer films, the first polymer film forming the upper side and at least a portion of the four side walls, the second polymer film forming at least a portion of the lower side.

DETAILED DESCRIPTION OF THE INVENTION

Figure 1:
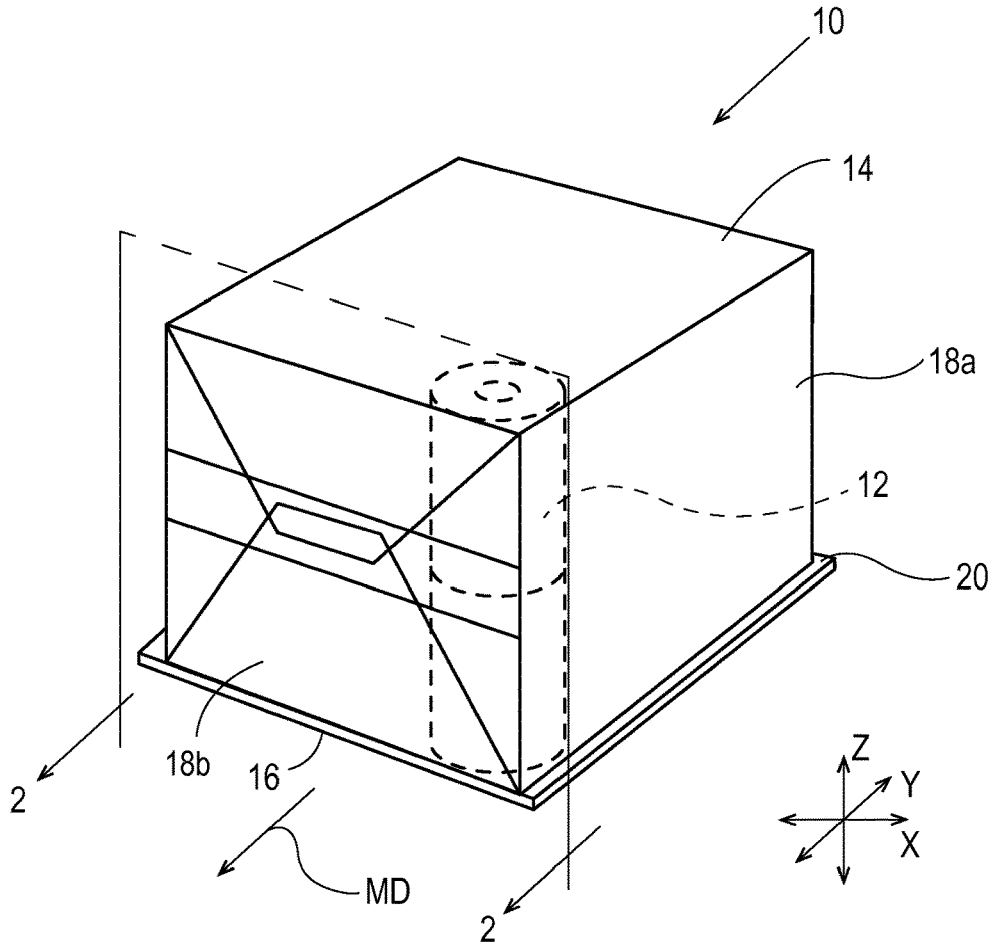
FIG. 1 is a perspective view of a package of the present invention.
Figure 2:
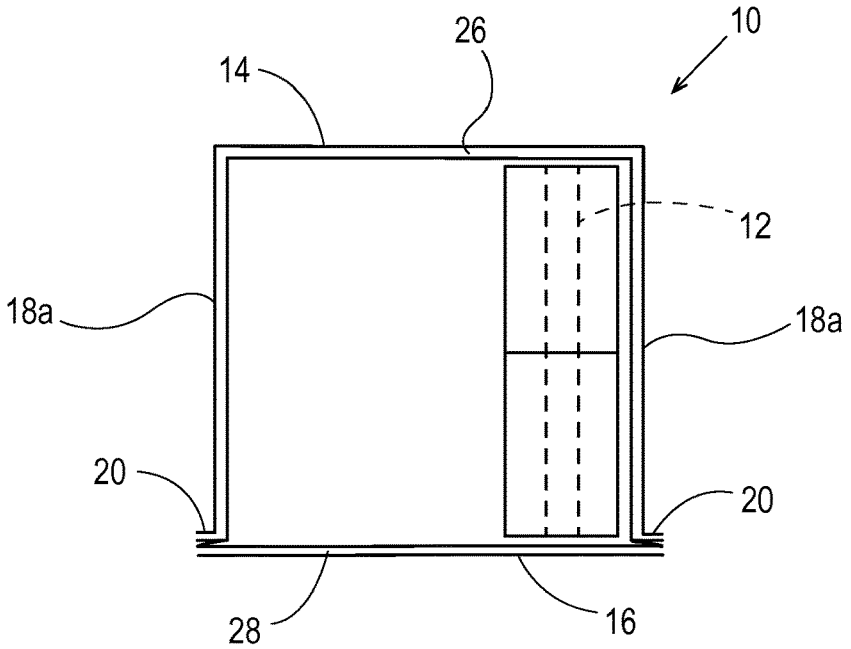
FIG. 2 is a cross-sectional view of the package shown in FIG. 1, taken along lines 2-2.

A package 10 of the invention is shown in FIG. 1, and in cross-section in FIG. 2. The package can contain products, such as rolled products 12, two of which are shown representatively stacked in FIGS. 1 and 2. The number and configuration of products can be selected according to the desired package size and shape. Package size and shape can be dictated by retailer requirements, such as shelving limitations, or shipping concerns, such as efficient trucking volume. For rolled products supplied on cores, such as paper towels supplied on cardboard cores, the rolled products can be packaged with their cores oriented vertically, i.e., in the Z-direction, with respect to a horizontal surface or process flow path generally corresponding to an X-Y plane, as shown in FIGS. 1 and 2. When packaged vertically, the rolled products, which can be sanitary tissue products like paper towels or toilet tissue, have their cores oriented orthogonally with respect to the lower side of the package. The rolled products can also be packaged with their cores oriented substantially horizontally (not shown), parallel to a horizontal surface or process flow path generally corresponding to an X-Y plane.

As shown in FIGS. 1 and 2, the package 10 can have an upper side 14 and a lower side 16 opposite and generally parallel to the upper side. The terms "upper" and "lower" are used herein to denote the sides associated with the side highest in elevation when processed in a horizontal process flow path (upper) and the side lowest in elevation when processed in a horizontal process flow path (lower) for purposes of description herein. But the terms are otherwise not to be limiting to the structure of the finished product, which could, for example, be inverted. Four side walls, two each of 18*a* and 18*b*, connect the upper side 14 to the lower side 16. The side walls can be considered as two generally opposite and parallel side walls 18*a* that are generally parallel to the machine direction MD of process flow path during processing. Likewise, two side walls 18*b* can be considered as the two "end" side walls that are sealed to form gusset seals, or the like.

The film of the upper side 14, lower side 16, and two side walls 18*a* can be free of any disruption due to package sealing, such as a lap seal, due to the presence of at least one fin seal 20 formed by a corner, or edge, defined by one side wall 18*a* and lower side 16, thus, achieving seal-free side walls 18*a*. Seal-free side walls 18*a* are of great value to a marketer of products because it permits packaging artwork to be displayed on at least four major package faces without disruption, providing greater display flexibility at the point of sale. By "seal-free" side wall is meant that the side wall does not have a lap seal, fin seal or gusset seal, except at a corner of the package. By "substantially seal free" is meant that a lap seal, fin seal or gusset seal the side wall does not cover more than about 10% of the area of the side wall.

Figure 3:
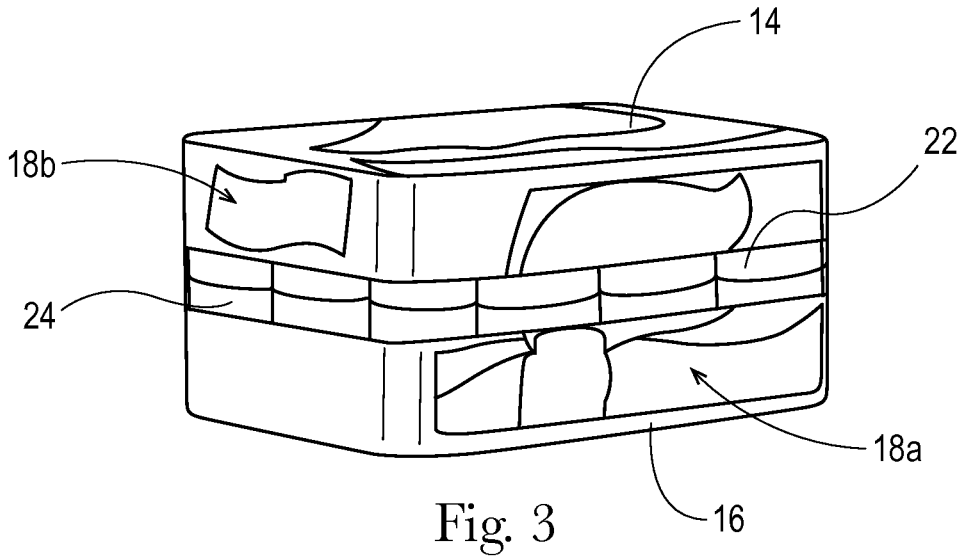
Fig. 3 PRIOR ART
FIG. 3 is a perspective view of a package showing one problem associated with existing wrap technology.

As shown in FIG. 3, in prior processes utilizing flow wrapper technology, the package produced invariably has a lap seal 22 across a side of the package, such as side 18*a* shown in FIG. 3, as well as gusset seals 24 on two end sides. Thus, in prior processes a significant portion of a consumer-facing side of a package, including one of the largest consumer-facing sides, could be marred by a lap seal that disrupts the intended packaging artwork at the point of sale.

Figure 4:
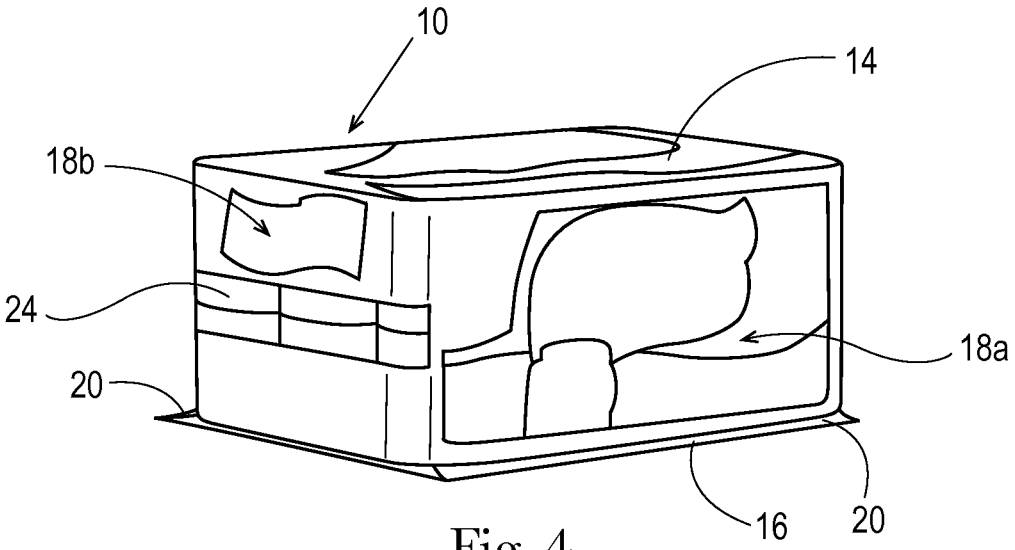
FIG. 4 is a perspective view of a package of an embodiment of the invention.

However, as shown in FIG. 4, a package 10 of the invention can have seal-free sides 18*a* as well as a seal-free upper side 14 and a seal-free lower side 16. Any seals, such as gusset seal 24 on end sides 18*b* and corner fin seals 20 at or near two corners of package 10, do not interfere with the manufacturer's packaging artwork on four large faces of the packaging. This provides at least four sides that are not marred with any kind of seal across a central portion of a major face of the package such that the manufacturer's packaging artwork can be displayed from any one of at least four sides (or faces) without disruption. The fin seals can be effectively coextensive with the corners of the package, or near, for example from 1% to 25% of the side wall height from the corner of the package, thereby leaving substantially all (greater than 75%) of the side wall seal free.

Another advantage of the package of the invention can best be understood with reference to FIG. 2. As shown, two polymer films, which can be two different polymer films, i.e., differing in at least one physical property, can be used to make up the package 10. A first polymer film 26 can form the upper side 14 and seal-free sidewalls 18*a*, and portions of end side walls 18*b*. A second polymer film 28 can form the lower side 16 and a portion of end side walls 18*b*. The first and second polymer films can be joined at corner fin seals 20 and gusset seals 24 to form an enclosed package of rolled products. Each polymer film has a width defined as the shortest distance between opposing side edges. In general, first polymer film 26 can have a width exceeding the width necessary to cover the top and two opposing sides of a plurality of packages to be wrapped (corresponding to the upper side 14 and sides 18*a* of the package). In general, second polymer film 28 can have a width exceeding the width necessary to cover the bottom of a plurality of packages to be wrapped (corresponding to the lower side 16 of the package).

As shown in FIG. 2, two polymer films are utilized and there are two corner fin seals. However, three or four polymer films can be utilized in a like manner as described herein, with three or four corner fin seals, respectively. In general, n polymer films can be utilized with n corner fin seals, with n being a positive integer. As such, the invention can be practiced with one film which can be sealed as described herein with one corner film seal.

The first and second polymer films 26 and 28 can have different properties due to their being different materials, different thicknesses, different blends, different surface properties, and the like. That is, the first and second polymer films 26 and 28 can have different material properties. The respective material properties can be selected according to the expected physical or aesthetic property needs of the package 10. For example, if lower side 16 is expected to take more physical abuse during shipping and handling, second polymer film 28 can be made of a higher thickness (caliper) film, or a stronger, more abrasion-resistant film, or a more durable film, or combinations of these properties, relative to the first polymer film 26. By stronger is meant, at least, that a film has higher tensile strength when tested according to standard tensile test methods. By abrasion-resistant is meant, at least, that a film can withstand greater abrasion before failure by rub through or tearing, when tested by known film abrasion techniques. By durable is meant greater durability when tested by standard film durability Likewise, if the top side 14 and sidewalls 18*a* and 18*b* are not expected to experience excessive physical abuse that might cause tearing, for example, then first polymer film 26 can be made of a lower caliper (thickness) film, or a weaker, less abrasion-resistant film, or a less durable film, or combinations of these properties, relative to the second polymer film 28. Further, there may be a difference in the ability of the first or second polymer films to be printed, embossed, or otherwise imparted with a visual appearance. First polymer film 26, for example, can be a relatively thin film that can take a vibrant printing ink for package artwork, while second polymer film 28 can be a relatively thick film that is relatively less printable, but more durable for stacking, shipping, and shelving.

In general, the first polymer film 26 can have first physical properties beneficial for the upper side 14 and at least a portion of the four side walls 18*a* and 18*b*, and the second polymer film can have second physical properties different from the first physical properties and beneficial for at least a portion of the lower side.

Apparatus for Making, and Process for Making

Figure 5:
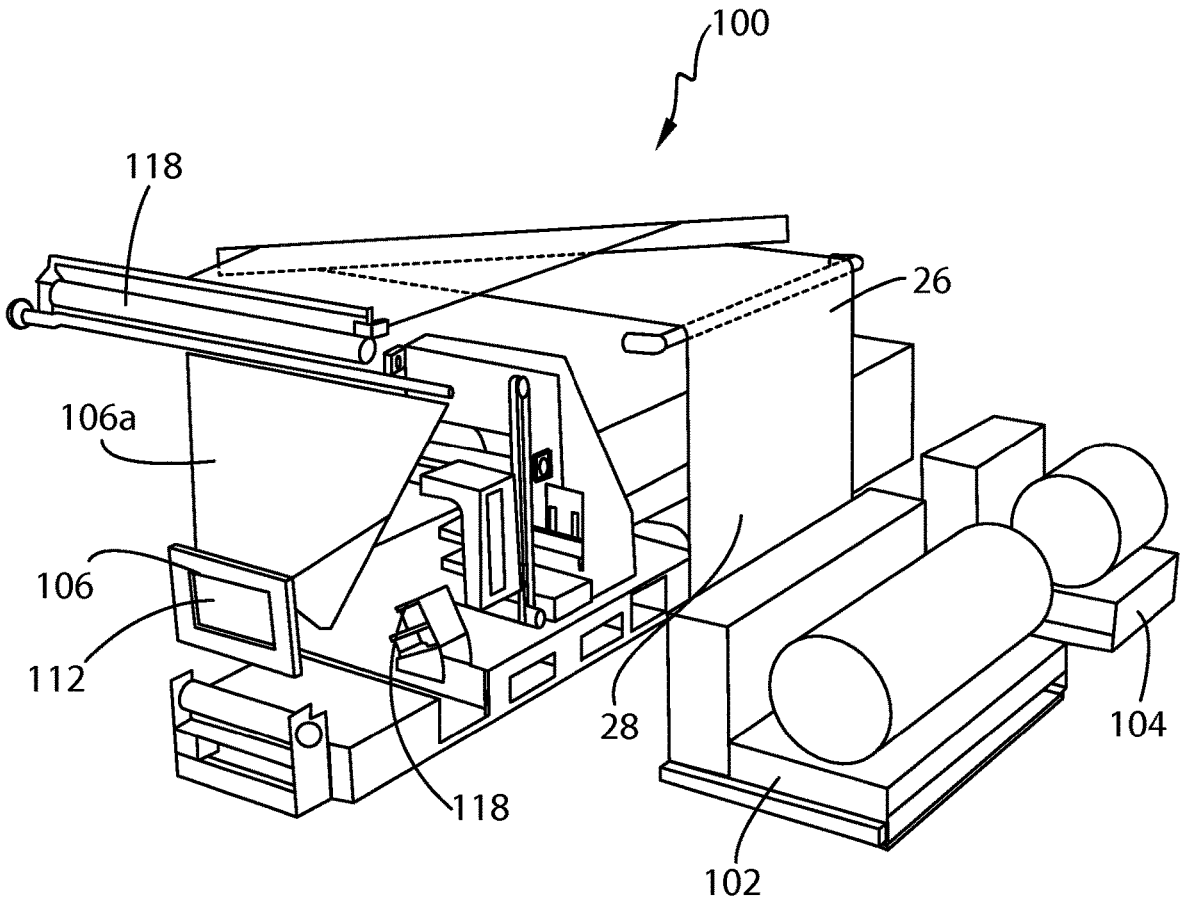
FIG. 5 is a perspective view of an apparatus for making a package of the invention.
Figure 6:
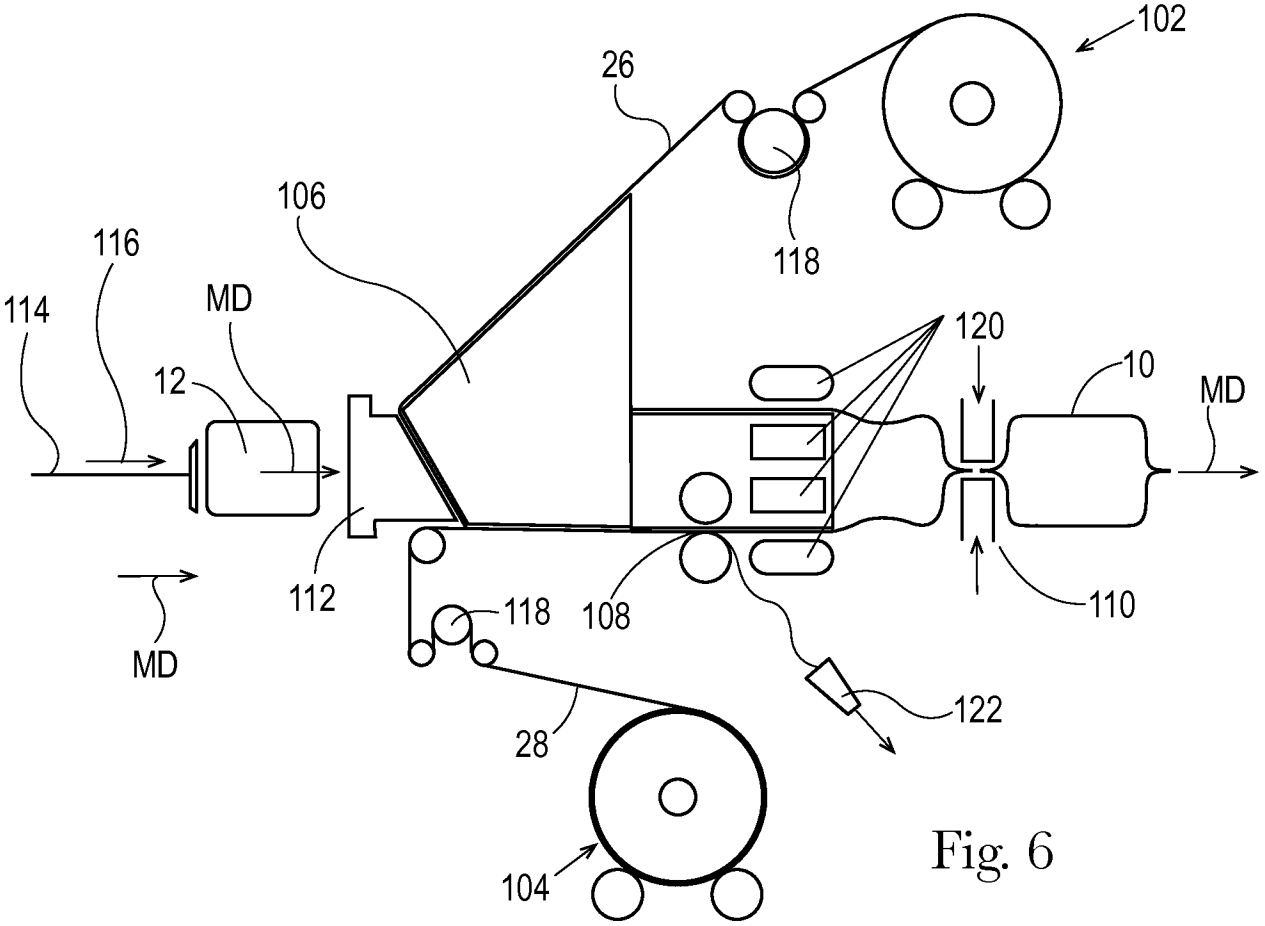
FIG. 6 is a schematic representation of an apparatus for making a package of the invention.

A package 10, as described above, can be manufactured using a process and apparatus as depicted in FIG. 5, and schematically in FIG. 6.

As shown in FIG. 5, the apparatus 100 can comprise two unwind stands 102, 104 for unwinding the first polymer film 26 and the second polymer film 28, respectively. First polymer film 26 and second polymer film 28 can be unwound and guided as necessary over various turning bars and metering units 118 to a tunnel that has associated therewith a forming horn 106. The forming horn is shaped to force the polymer films 26 and 28 into a desired geometry over products that enter the forming horn 106 via a conveyor or other product moving device, such as a pushing device 114 (as shown in FIG. 6). In particular, the forming horn is made by methods known in the art for making forming horns to form first polymer film 26 into a shape suitable for covering the upper side 14 and at least a portion of side walls 18*a* as the rolled products are pushed through the forming horn 106. First and second polymer films 26 and 28 are sealed by at least one corner fin seal made by a corner sealer 108 to form essentially a tube of polymer. In an embodiment, two corner sealers 108 are utilized to form two fin seals 20, one each on the corner edges defined at the juncture of each seal-free side wall 18*a* and the lower side 16, as depicted in FIGS. 1 and 2.

As shown schematically in FIG. 6, polymer films 26 and 28 can be unwound from unwind stands 102 and 104, respectively, and each film can be metered through a set of metering units 118, as is known in the art for controlling speed, tension, or both in a web handling process. Rollers, idler rolls or turning bars, also as known in the art, can be used throughout the apparatus as necessary to guide and turn the polymer films as desired.

The forming horn 106 is used to form polymer film 26 into a shape fitting geometry for the product 12 of product entering through tunnel 112 to be wrapped by polymer film 26. While a tunnel is exemplified, any suitable conveyance or passageway for packages to be wrapped can be utilized, and the term "tunnel" is not intended to imply any particular shape or level of enclosure. In an embodiment, first polymer film 26 can be formed by the forming horn 106 into generally an inverted "U" shape, as depicted in FIG. 2. As such, the first polymer film 26 can be formed to cover the top and two sides of the product 12 entering the forming horn, thereby forming the upper side 14 and two seal-free sides 18*a* of the resulting package 10 of product 12.

Second polymer film 28 can be guided into the forming horn section under product 12 in a substantially flat configuration to cover the bottom of the product 12. The lateral edges of both the first polymer film 26 and second polymer film 28 are brought in close proximity for sealing by corner sealers 108 to form fin seals 20 as shown in FIGS. 1 and 2. First and second polymer films form essentially a tube which can take the shape of the product being pushed through it, with the first polymer film forming the upper side 14 and two seal-free sides 18*a* of the package and the second polymer film forming the lower side 16.

Figure 7:
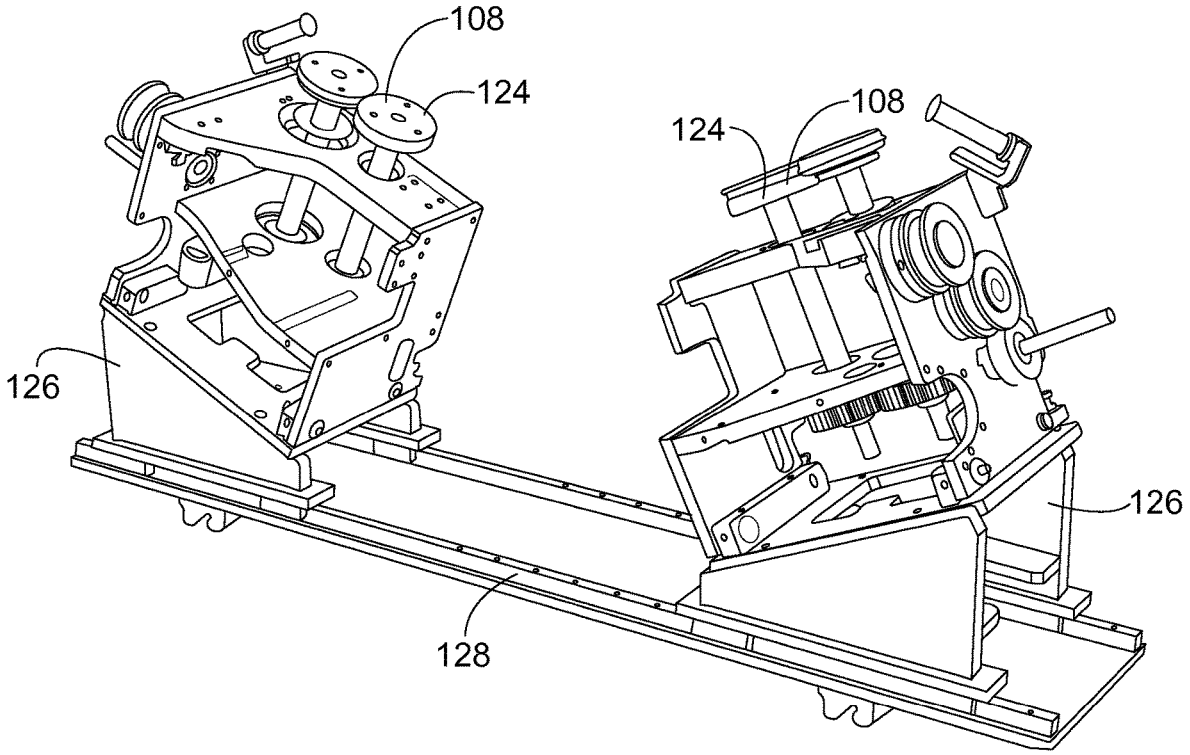
FIG. 7 is a perspective view of a corner sealing apparatus.

As shown in FIG. 7 fin seals 20 can be made by one or more corner sealers 108, each of which can have a pair of engaging, heated wheels 124, between which edge portions of first polymer film 26 and second polymer film 28 pass under pressure to be sealed by heat, and/or pressure. The temperature, dwell time, and pressure of the heated wheels 124 can be adjusted as required for a necessary for the desired polymer films and line speed. Excess film material beyond the fin seals 20 of the partially formed package can be removed by cutting, or other known edge trimming methods. In an embodiment, the sealing wheels perform a dual function of creating the corner fin seal and simultaneously cutting off excess material as trim. The trimmed edge material can be removed by a system of rolls to be directed away from the apparatus for disposal. The system can include trim blowers 122 direct edge trim away from the sealing operation. Once the corner fin seals 20 are made, the partially sealed tube of film can be pulled further through the tunnel by one or more externally contacting belt-drives 120 which pull the partially wrapped package to a gusset sealer to be gusset sealed by gusset sealing dies 110. Once the gusset seals 24 are formed, the package 10 can be conveyed for further processing, shipping or display.

Each set of corner sealers 108 can be mounted by slide mount 126 to a slide platform 128 for adjustment as necessary depending on package size and fin seal placement. Corner fin seals can also be made by ultrasonic sealing or hot air sealing.

In operation for a bundle of rolled products, product 12 can be pushed into the tunnel and through the forming horn by a pusher 114 in the machine direction MD as indicated by arrow 116 through the forming horn 106 to be partially covered with the first and second polymer films. The pusher 114 can be a simple device capable of pushing product on a feed conveyor into the forming horn, as is known in the art, and which can retract or fall back at the point of transfer into the forming horn and, into the unsealed tube effectively formed by the first and second polymer films. For larger bundles of rolled product, the pusher 114 can also be a linearly translating (in the MD) device that directly pushes the bundle through the tunnel and forming horn until the bundle emerges from the tunnel (referred to as "push out") and is inside the partially sealed tube of polymer film. Product 12 which is now a bundle partially wrapped by the sealed tube of film formed by the first and second polymer films can be pulled by belt drives 120 applying external pressure to the film tube. After the corner fin seal(s) is/are made, a downstream gusset seal can be made, and the product, which can be a plurality of rolled product 12 can be pushed into the sealed polymer tube against the downstream gusset seal 24. The pushing device 114 can then be retracted and the upstream (second and final) gusset seal 24 can be made. Gusset seals can be made by gusset sealing dies 110 that forms a gusset seal 24 and can be utilized to cut the polymer to form a package 10 of rolled products 12.

What is claimed is:

1. A package containing rolled products, the package comprising an upper side, a lower side opposite and generally parallel to the upper side; four side walls including two end walls, the sidewalls connecting the upper side to the lower side; the package comprising at least a first and a second polymer film, the first polymer film having first physical properties and forming the upper side and at least a portion of the four side walls, the second polymer film having second physical properties and forming at least a portion of the lower side, wherein the first and second polymer films are joined by at least one corner fin seal along one edge defined by the juncture of one side wall and the lower side, and wherein each of the two end walls include a gusset seal, wherein the gusset seal comprises a first gusset flap connected to an edge of the upper side and the first gusset flap folded approximately perpendicular from a plane formed by the upper side, and a second gusset flap connected to an edge of the lower side and the second gusset flap folded approximately perpendicular from a plane formed by the lower side, wherein the first and second gusset flaps overlap only at end edges of the first and second gusset flaps to form the gusset seal, and wherein the plane of the upper side and the plane of the lower side are spaced from each other and are parallel with each other.

2. The package containing rolled products claim 1, wherein the rolled products are rolled sanitary tissue products.

3. The package containing rolled products claim 1, wherein the second polymer film has a better abrasion resistance than the first polymer film.

4. The package containing products of claim 1, wherein the package has two said fin seals.

5. The package containing products of claim 1, wherein the first polymer film has a lower caliper than the second polymer film.

6. The package containing products of claim 1, wherein the upper side, lower side and side walls form major faces of the package, and the package has at least four seal-free faces.

7. A package containing rolled sanitary tissue products, the package comprising an upper side, a lower side opposite and generally parallel to the upper side; four side walls including two end walls, the sidewalls connecting the upper side to the lower side; the package comprising at least a first and second polymer films, the first polymer film having first physical properties and forming the upper side and at least a portion of the four side walls, the second polymer film having second physical properties and forming the lower side, wherein the first and second polymer films are joined by two fin seals, one each along each corner edge defined by two opposing side walls and the lower side, and wherein each of the two end walls include a gusset seal, and wherein the upper side, lower side and side walls form major faces of the package, and the package has at least four seal-free faces and two faces with gusset seals, wherein the gusset seals each comprise a first gusset flap connected to the upper side and a second gusset flap connected to the lower side, wherein the first and second gusset flaps overlap only at end edges of the first and second gusset flaps.

8. The package of claim 7, wherein the sanitary tissue products are selected from the group of paper towels and toilet tissue.

9. A package containing rolled products, the package comprising an upper side, a lower side opposite and generally parallel to the upper side; four side walls including two end walls, the sidewalls connecting the upper side to the lower side; the package comprising at least a first and a second polymer film, the first polymer film forming the upper side and at least a portion of the four side walls, the second polymer film forming at least a portion of the lower side, wherein the first and second polymer films are joined by two fin seals, one each along each corner edge, and wherein each of the two end walls include a gusset seal, wherein the gusset seal comprises a first gusset flap connected to the upper side and a second gusset flap connected to the lower side, wherein the first and second gusset flaps overlap only at end edges of the first and second gusset flaps.

10. The package of claim 9, wherein the rolled products are rolled sanitary tissue products.

* * * * *